United States Patent [19]

McRoberts

[11] 4,399,847

[45] Aug. 23, 1983

[54] APPARATUS FOR DRAINING VISCOUS FLUIDS

[76] Inventor: William J. McRoberts, 2475 Brookshire Dr., Schenectady, N.Y. 12309

[21] Appl. No.: 366,719

[22] Filed: Apr. 8, 1982

Related U.S. Application Data

[63] Continuation of Ser. No. 906,432, May 17, 1978, abandoned.

[51] Int. Cl.[3] ..... B65B 3/06

[52] U.S. Cl. ..... 141/364; 248/311.3

[58] Field of Search ..... 141/363-366, 141/375, 391, 392; 248/311.3, 146

[56] References Cited

U.S. PATENT DOCUMENTS

| | | | |
|---|---|---|---|
| 496,537 | 5/1893 | Purrington | 141/364 |
| 776,332 | 11/1904 | Kloeppinger | 248/311.3 X |
| 2,807,290 | 9/1957 | Hearn | 141/364 X |

*Primary Examiner*—Frederick R. Schmidt

*Attorney, Agent, or Firm*—Gerhard K. Adam

[57] ABSTRACT

An apparatus for draining viscous fluid from a delivering container to a receiving container is provided including a support member for placing the delivering container in the inverted position whereby the sides of the delivering container become inclined and the fluid is permitted to drip from the mouth thereof, said member having a lower section for mounting to a base, a middle section which directs the draining of the viscous fluid, and an upper section for supporting the delivering container.

8 Claims, 4 Drawing Figures

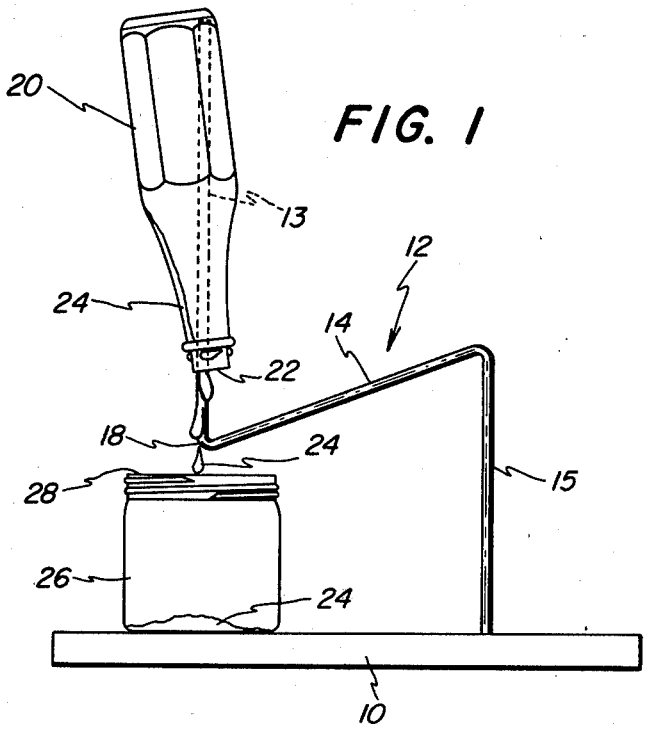
FIG. 1
FIG. 2
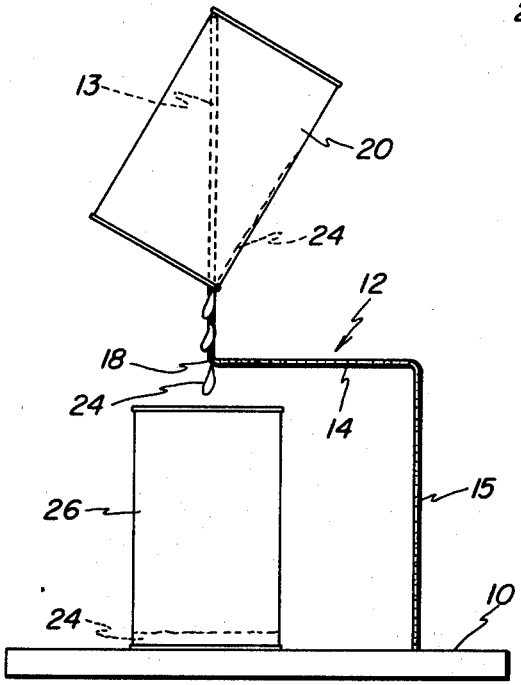
FIG. 3
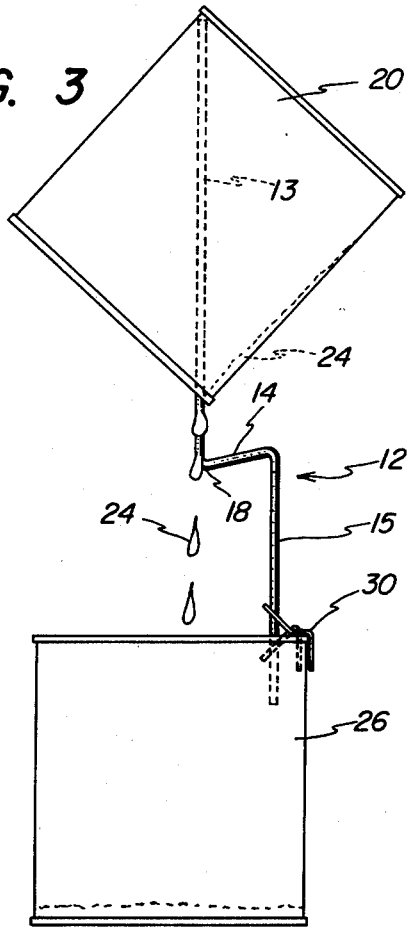
FIG. 4
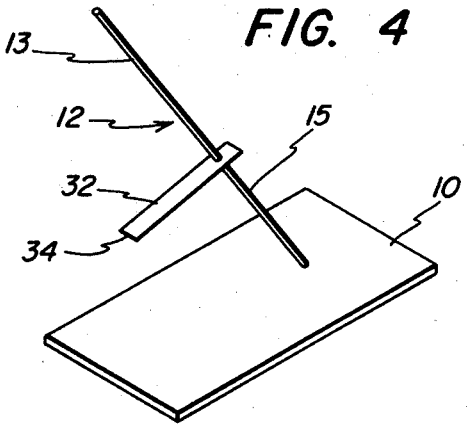

APPARATUS FOR DRAINING VISCOUS FLUIDS

This application is a continuation, of application Ser. No. 906,432, filed May 17, 1978 now abandoned

BACKGROUND OF THE INVENTION

Viscous fluids, such as honey, catsup, pancake syrup, salad dressing etc. are ordinarily sold and stored in narrow mouthed containers or bottles. Typically, people empty the containers by holding them upside down and permitting the fluid to drain out and, when the contents no longer readily flow therefrom, the bottle and the residue are thrown away. This problem becomes even more exaggerated when the fluid is cooled in a refrigerator since the viscosity of the fluid increases as the temperature is decreased. Thus a substantial amount of fluid may be lost and wasted.

Previously, it has been proposed to employ connectors or couplings adapted for connecting to the neck portion of a bottle, jar or the like, and for supporting one container in inverted position on another to effectively seat the joint between the containers. A coupling device to support one container in inverted position on another container to drain the same is disclosed in McHale, U.S. Pat. No. 3,266,533 in which the coupling is adapted for slip-fit frictional engagement with the outlet portions of the containers. Whether of the threaded-type or the slip friction-type, these coupling devices connect the outlet portion of the container from which the viscous fluid is being drained and the outlet portion of the other container. A disadvantage is that the connectors have to have the correct size to match the opening of the containers and usually both ends of the connector have to be the same size.

It is therefore an object of the present invention to provide an apparatus for draining viscous fluids from one container to another which is useful for containers of various outlet sizes.

SUMMARY OF THE INVENTION

In accordance with my invention, I have discovered an apparatus for draining viscous fluids from a first or delivery container into a second or receiving container. The apparatus includes a base on to which the receiving container may be placed and a longitudinal support member having a lower section for mounting to the base, a middle section which directs the draining of the viscous fluid, and an upper section for supporting the delivering container. When using this apparatus it is contemplated that the delivering container be located above the receiving container, with the mouth of the delivering container being positioned to deliver the fluid and the mouth of the receiving container being positioned to receive the fluid, and the side of the delivering container is inclined to permit dripping from the mouth thereof.

DESCRIPTION OF THE DRAWING

The invention is more clearly understood from the following description taken in conjunction with the accompanying drawing in which:

FIG. 1 is a side view of the apparatus showing an inverted delivering container located on the support member and above the receiving container.

FIG. 2 is a side view of another embodiment of the present invention.

FIG. 3 is a side view of a further embodiment of the invention showing the receiving container functioning additionally as the base.

FIG. 4 is a perspective view of another embodiment showing an apparatus in which the support member has a modified drip-directing section.

Referring now to the drawing, in the embodiment illustrated by FIG. 1, the draining apparatus of the present invention in comprised of a flat base 10 preferably made of wood onto which is mounted the support member 12 formed from a preshaped rod of metal or plastic. The support member 12 may be considered in three sections. The upper section 13 is for projecting into the delivering container 20, as illustrated by a catsup bottle, in an inverted and slightly inclined position and makes physical contact with the mouth 22 of the delivering container 20. The lower section 15 of the support member 12 provides support for the upper section 13 and is mounted to the base 10. Between the upper section 13 and the lower section 15 is an intermediate section 14 which provides a spacial arrangement to permit the mouth 22 of the delivering container 20 to be in delivering relationship and the mouth 28 of the receiving container to be in receiving relationship with regard to the viscous fluid 24. The drip-directing point 18 at which the upper section 13 and the intermediate section 14 meet is critical since that is the approximate site from which the viscous fluid 24 drips by means of gravity into the receiving container 26. Intermediate section 14 must be in a horizontal plane or rise from point 18 so that point 18 is a low point during the descent of the viscous fluid. As shown in this illustration, it is preferred that the angle between the upper section 13 and the intermediate section 14 form an acute angle but in no event should this angle be greater than a right angle to avoid having the viscous fluid 24 draining down the entire support member 12 and onto base 10.

FIG. 2 is an apparatus similar to FIG. 1 except that the viscous fluid 24 draining from the delivering container 20 to the receiving container 26 is an oil such as SAE 10W-40. The angle at point 18 between the upper section 13 and the intermediate section 14 of the support member 12 is approximately a right angle which is the maximum angle that may be used. The fluid 24 then continues to drip at point 18 until the delivering container 20 is substantially empty at which time another delivering container may be put in its place until the receiving container 26 is filled.

FIG. 3 is a further modification in which the supporting member 12 is similar to those of FIG. 1 and FIG. 2 except that the receiving container 26 is sufficiently stable that it serves as the base for the apparatus. A connection is made between the supporting member 30 and the delivering container 26 by means of a clamp 30 which fits onto the lower section 15. The clamp 30 has a configuration at one end similar to a clothespin attached to the support member 12 and at the base a three pronged arrangement to fit on the rim of the delivering container 26.

An alternative embodiment is illustrated by FIG. 4 in which the intermediate section 14 of the support member 12 as shown in FIG. 1, is replaced by a baffle 32 attached at an intermediate point on the support member 12. The viscous fluid is permitted to drip down the upper section 13 and along the baffle 32 until it reaches drip edge 34 at which the fluid drips into a receiving container not shown.

The materials used in forming the apparatus are not really critical and for example the base can be made of wood or metal and the support member may be formed from a metal rod. The base and support member may also be made from conventional moldable plastic materials such as vinyl polymers, acrylics and phenolics.

It will be appreciated that the invention is not limited to the specific details shown in the examples and illustrations and that various modifications may be made within the ordinary skill in the art without departing from the spirit and scope of the invention.

I claim:

1. An apparatus for draining a viscous fluid from a delivering container to a receiving container comprising a base and a support member for placing the delivering container in the inverted position whereby the sides of the delivering container become inclined and the fluid is permitted to drain from the mouth thereof onto the support member, said member having a lower section for mounting to said base, an intermediate section for directing the draining of the fluid and an upper section for inserting into the delivering container and for supporting the delivering container in the inverted position, said upper section being long enough for the bottom of the inverted container to rest thereon and to maintain said container above said intermediate section, wherein a drip-directing point for permitting dripping of said fluid by means of gravity is formed between said intermediate section and said upper section, said intermediate section being in a horizontal plane or rising from said point.

2. The apparatus of claim 1, wherein the mouth of the delivering container is positioned to deliver said fluid and the mouth of the receiving container is positioned to receive said fluid.

3. The apparatus of claim 1, wherein said support member is clamped at the lower section thereof to said receiving container and whereby said receiving container forms said base.

4. The apparatus of claim 1, wherein said intermediate section is a baffle connected at a point between said upper section and said lower section.

5. The apparatus of claim 1, wherein said base and said support member are formed from a moldable plastic material.

6. The apparatus of claim 5, wherein said moldable plastic materials are selected from the group consisting of vinyl polymers, acrylics and phenolics.

7. The apparatus of claim 1, wherein said support member is formed from a metal rod.

8. The apparatus of claim 7, wherein said base is made of wood.

* * * * *